US007559688B2

(12) United States Patent
Robert-Nicoud et al.

(10) Patent No.: US 7,559,688 B2
(45) Date of Patent: Jul. 14, 2009

(54) TIMEPIECE WITH TWO ROTATING BEZELS

(75) Inventors: Bertrand Robert-Nicoud, La Neuveville (CH); Alberto Rodriguez, Neuchâtel (CH)

(73) Assignee: Tissot S.A., Le Locle (CH)

( * ) Notice: Subject to any disclaimer, the term of this patent is extended or adjusted under 35 U.S.C. 154(b) by 0 days.

(21) Appl. No.: 10/598,942

(22) PCT Filed: Mar. 11, 2005

(86) PCT No.: PCT/EP2005/002585

§ 371 (c)(1),
(2), (4) Date: Jul. 28, 2008

(87) PCT Pub. No.: WO2005/101138

PCT Pub. Date: Oct. 27, 2005

(65) Prior Publication Data

US 2008/0279053 A1 Nov. 13, 2008

(30) Foreign Application Priority Data

Mar. 16, 2004 (EP) ..... 04006172

(51) Int. Cl.
*G04B 37/00* (2006.01)
*G04B 39/00* (2006.01)

(52) U.S. Cl. ..... 368/294; 368/295

(58) Field of Classification Search ..... 368/88, 368/276, 281, 294–296
See application file for complete search history.

(56) References Cited

U.S. PATENT DOCUMENTS

| | | | | |
|---|---|---|---|---|
| 3,431,722 | A * | 3/1969 | Haas | 235/61 R |
| 3,548,588 | A | 12/1970 | Piquerez | |
| 3,665,701 | A | 5/1972 | Burdet | |
| 7,137,732 | B2 * | 11/2006 | Takeda | 368/295 |
| 2002/0021624 | A1 * | 2/2002 | Hiranuma et al. | 368/282 |
| 2006/0171256 | A1 * | 8/2006 | Herbert | 368/21 |

FOREIGN PATENT DOCUMENTS

| | | |
|---|---|---|
| CH | 308601 | 10/1955 |
| DE | 201 18 869 U1 | 7/2002 |
| FR | 2.192.331 | 2/1974 |
| FR | 2 810 751 | 12/2001 |
| WO | 93/24867 | 12/1993 |

OTHER PUBLICATIONS

International Search Report issued in corresponding International Application No. PCT/EP2005/002585 completed Jun. 10, 2005 and mailed Jun. 17, 2005.

* cited by examiner

*Primary Examiner*—Vit W Miska
(74) *Attorney, Agent, or Firm*—Griffin & Szipl, P.C.

(57) ABSTRACT

The timepiece includes a case formed of a back cover and a middle part closed by a glass arranged above a dial with an analogue or digital display, delimiting the housing of a watch movement, said glass being surrounded by two external rotating top and bottom bezels, superposed on a shoulder of the middle part. It is characterized in that the two bezels and the shoulder have identical or similar non-circular or non-symmetrical contours in relation to the center of the dial in the superposed position, and in that the bezels can occupy a first rest position in which concealed parts of the shoulder and/or concealed parts of the bottom bezel are made visible after rotation of at least one bezel.

19 Claims, 4 Drawing Sheets

TIMEPIECE WITH TWO ROTATING BEZELS

This is a National Phase Application in the United States of International Patent Application No. PCT/EP2005/002585 filed Mar. 11, 2005, which claims priority on European Patent Application No. 04006172.3, filed Mar. 16, 2004. The entire disclosures of the above patent applications are hereby incorporated by reference.

FIELD OF THE INVENTION

The present invention concerns a timepiece, and more particularly a wristwatch comprising two rotating bezels each having substantially the same non-circular or non-symmetrical contour in relation to the centre of the dial.

BACKGROUND OF THE INVENTION

Timepieces provided with two rotating bezels, arranged in accordance with three different embodiments are already known.

In CH Patent No. 308 601, the watch comprises a device formed of two external bezels in the form of juxtaposed rings, respectively bearing the hour and minute symbols, allowing an interval of time to be measured with said watch. The watch disclosed in FR Patent No 2, 192 331 also comprises two superposed concentric external rotating bezels. The top bezel, which can be manipulated in rotation by means of a lateral knurled member, comprises only one aperture able to be positioned facing a determined time indication. The bottom bezel can be manipulated in rotation by means of a top knurled member to bring one of the indications that it carries opposite the aperture and to let the user know of the imminence of a given event. As can be seen in the two aforecited documents, manoeuvring the bezels only enables the information displays to be altered without any significant influence on the overall external appearance of the watch.

According to a second embodiment, illustrated by example by U.S. Pat. No. 3,548,588, the device comprises an external bezel and an internal bezel, visible through the glass and able to be manipulated by the crown, for displaying various information on their periphery, but evidently both being circular, without any possibility of superposition.

According to a third embodiment, illustrated by U.S. Pat. No. 3,665,701, the two rotating bezels are located inside the watch case underneath the glass, in a substantially symmetrical configuration to that disclosed in CH Patent No. 308 601 and are driven in rotation by manipulations carried out on the crown.

As can be seen, these three embodiments enable information to be displayed in relation to the passing of time, but manipulating the bezels does not substantially alter the external appearance of the watch

SUMMARY OF THE INVENTION

The invention thus concerns a embodiment that differs from those previously described in that the relative rotation of one rotating bezel with respect to the other, whether it is carried out manually or automatically, alters the visual appearance of the watch, said rotation also being possibly associated, in a passive or active manner, with the passing of time.

The invention therefore concerns a timepiece, which will be essentially illustrated hereinafter by a wristwatch comprising a case formed of a back cover and a middle part closed by a glass arranged above a dial with an analogue or digital display, delimiting the housing of a watch movement, said glass being surrounded by two rotating external upper and lower bezels, superposed on a shoulder of the middle part. The wristwatch is characterised in that the two bezels and the shoulder, on which they can be manoeuvred in rotation, have identical or similar contours that are non-circular or non-symmetrical in relation to the centre of the dial in the superposed position. Thus, the bezels can occupy a first rest position in which they are essentially superposed above the shoulder of the middle part and a second position in which concealed parts of the shoulder and/or concealed parts of the lower bezel are made visible after rotating at least one bezel.

Within the scope of the present description, "similar contour" means that the contour of one element, the shoulder or the bezel, can comprise an enlarging strip leaving said strip apparent in the rest position, while concealing other surfaces of said element.

In a preferred embodiment, the shoulder and the bezels have a curved oblong shape, for example an oval shape. The bezels can be rotated manually, possibly with the bezels driving each other, or automatically by means of mechanical driving that can be programmed from the movement. As a function of their angle of rotation from the rest position, they can also activate/deactivate a function integrated in the timepiece in conjunction with or independent of the passing of time, such as activating an alarm time or passage into a display mode that is not linked to the passing of time.

As can be seen, in such a timepiece, the particular design of the rotating bezels allows the external appearance of the watch to be altered by revealing decorations that are normally hidden in the rest position, such as inlaid jewellery, and can allow interaction with the watch movement.

SHORT DESCRIPTION OF THE DRAWINGS

Other features and advantages of the present invention will appear upon reading the description of various embodiments given by way of illustrative and non-limiting example with reference to the annexed drawings, in which.

DETAILED DESCRIPTION OF THE INVENTION

Figure 1:
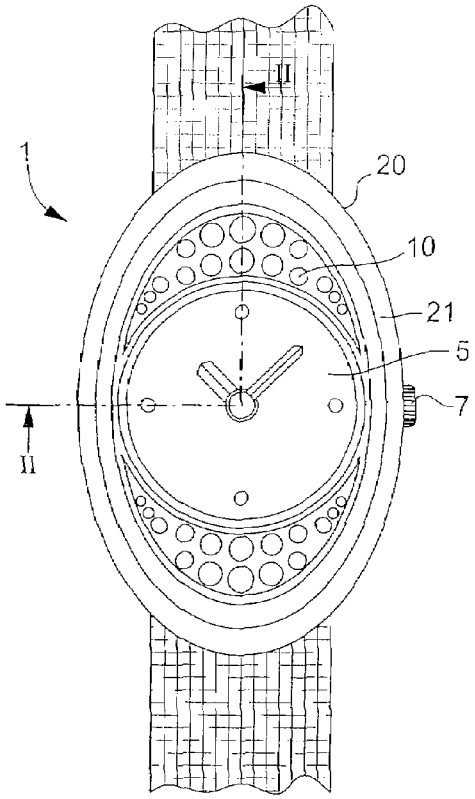
FIG. 1 is a top view of a first embodiment.
Figure 2:
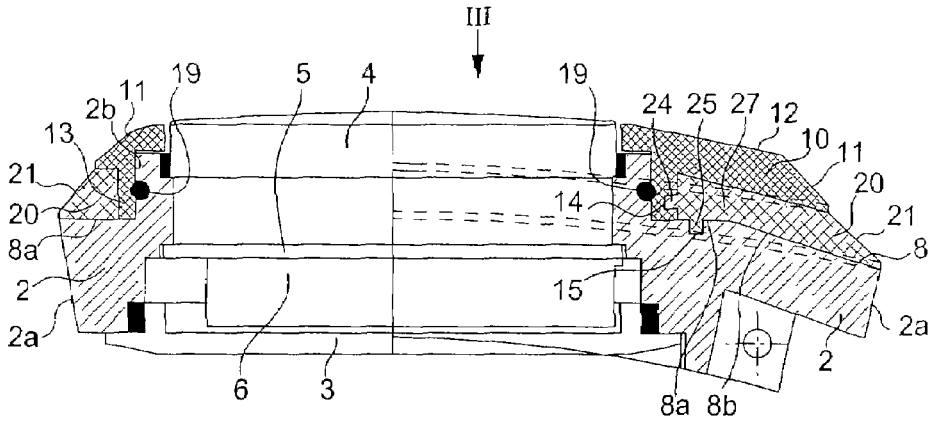
FIG. 2 is a cross-section along the line II-II of FIG. 1.

FIG. 1 shows a top view of a timepiece according to the invention, illustrated by a wristwatch, in the "rest" position, also shown in FIG. 2 in a cross-section II-II passing through the 9 o'clock and 12 o'clock positions. The watch comprises a case 1 formed of a back cover 3 and a middle part 2 closed by a glass 4 arranged above a dial 5 with an analogue display delimiting the housing of a watch movement 6 provided with an external control member 7, such as a crown-push-button. In the example shown, glass 4 and dial 5 have a circular shape, but the external contour 2*a* of middle part 2 of the wristwatch is oval, i.e. with two axes of symmetry at 12 o'clock -6 o'clock and 3 o'clock-9 o'clock, but without symmetry of rotation.

Glass 4 is surrounded by a top rotating bezel 10 and a bottom rotating bezel 20, the two bezels 10, 20 having an oval shape and being superposed above a shoulder 8 of middle part 2. Shoulder 8 is formed of a ring 8*a*, parallel to the surface of the dial, and two rounded parts 8*b* inclined towards back cover 3 and defining the oval shape.

In the rest position shown in FIGS. 1 and 2, the base of the bottom bezel 20 totally covers the inclined parts 8*b* and partially covers ring 8*a* of shoulder 8. The top surface of bottom bezel 20 is parallel to the inclined parts 8*b* and extends above the zone 8*a* covered by said bottom bezel 20, the connection between the base and the top part forming an inclined plane 21 permanently visible over the entire periphery of the wristwatch. It will be observed that this design of the bezel has a cork-like shape 27 whose narrowest part is at the break between parts 8*a*, 8*b* of shoulder 8.

The base of top bezel 10 comprises a part abutting over the entire top surface of bottom bezel 20, said abutting part being extended by a foot 13 extending as far as ring 8*a* of shoulder 8 in the space delimited by the vertical wall 2*b* of middle part 2 joining ring 8*a* of shoulder 8 and the inner vertical wall of bottom bezel 20.

The visible face of top bezel 10 comprises an inclined surface 12 parallel to the base of said bezel and a connection 11 to said base, inclined and substantially parallel to connection 21 of bottom bezel 20.

The two bezels 10, 20 were designed to allow very simple assembly. After having positioned bottom bezel 20 on the outer part of shoulder 8*a*, foot 13 of top bezel 10 is snap fitted into wall 2*b* of middle part 2, snap fit means 19 being schematically represented by an annular spring. Cork 27 improves the holding and positioning of bottom bezel 20.

Figure 4:
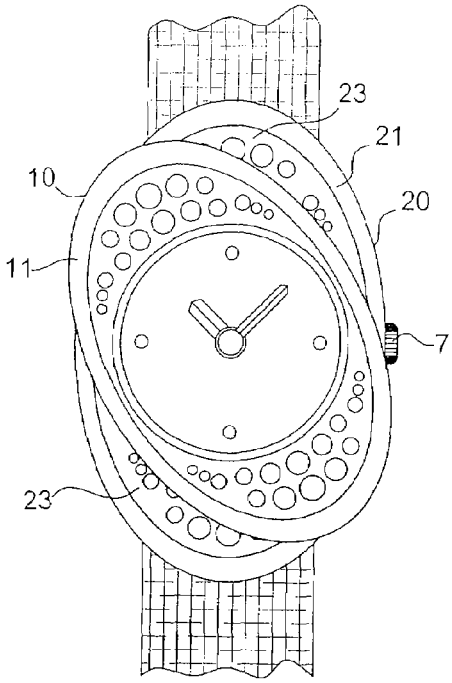
FIGS. 4 to 7 show the various spreading steps of the rotating bezels of FIG. 1.
Figure 5:
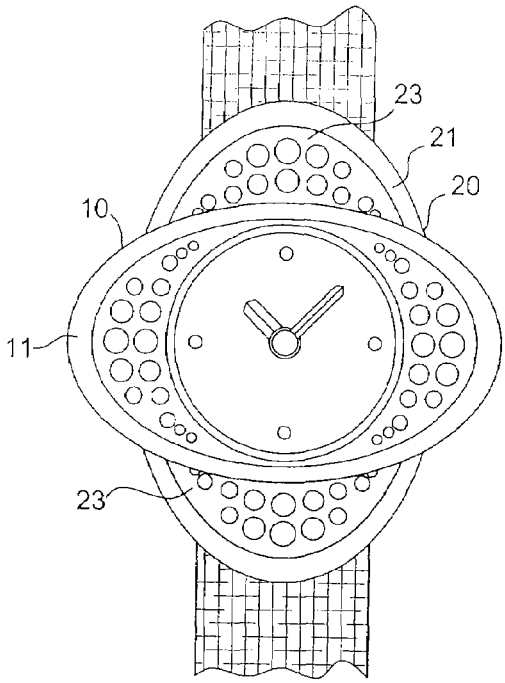

With reference now to FIGS. 4 to 7, the different aspects of the wristwatch are shown when bezels 10, 20 are rotated from the rest position shown in FIG. 1, i.e. when said bezels are superposed. In FIG. 4, top bezel 10 starts to rotate in the anti-clockwise direction revealing portions of concealed parts 23 of bottom bezel 20 which has remained in its initial position. In FIG. 5, the two bezels 10, 20 have a symmetrical position in a cross. It will be observed that this configuration already constitutes a decorative design as such. In other words, a single rotating bezel having the asymmetrical features listed at the beginning can already attain one of the objects of the invention.

Figure 6:
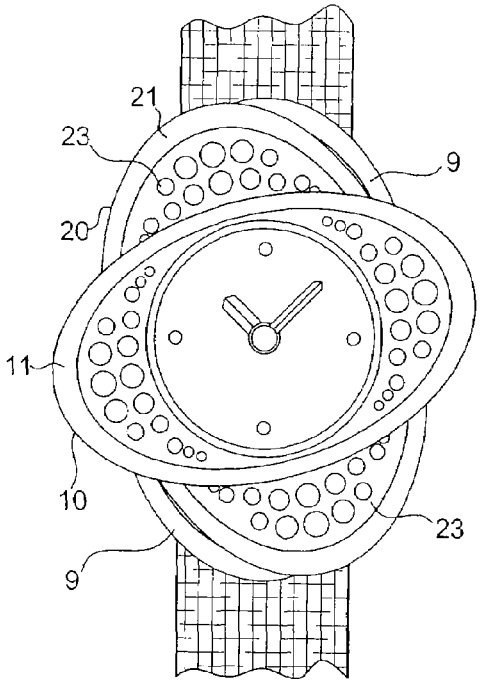
Figure 7:
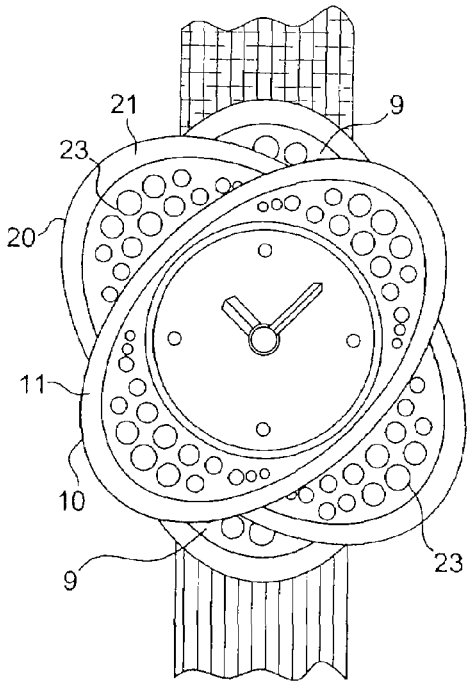

In FIG. 6, top bezel 10 continues to rotate, driving bottom bezel 20 trough the same angle of rotation and causing portions of concealed parts 9 of shoulder 8 to appear. In FIG. 7 the two bezels have been brought into symmetrical positions, which, in this example, correspond to a rotation of top bezel 10 through 135° and of bottom bezel 20 through 45° in the anti-clockwise direction, although other choices are possible, for example with rotations of 120° and 60°.

Figure 3:
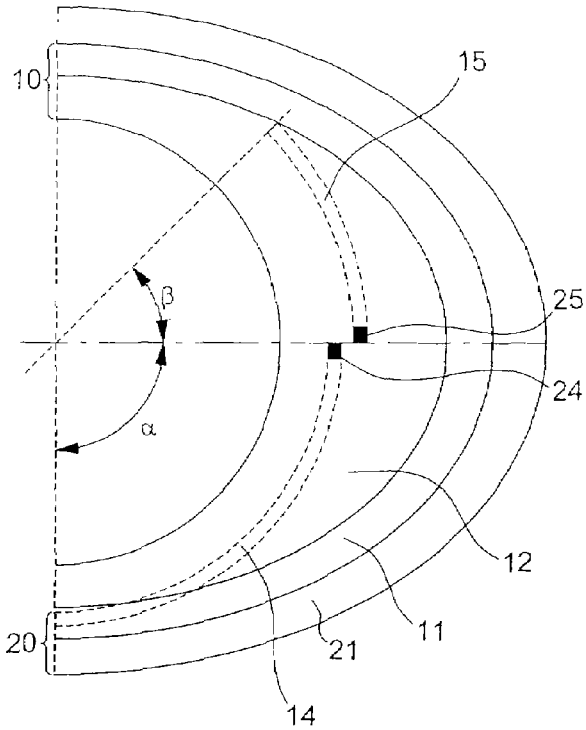
FIG. 3 is a half-view from above showing the concealed parts along the arrow III of Figure II.

In order to facilitate the symmetrical positioning of bezels 10, 20, it is advantageous to provide hollow cams for controlling the angular clearance of each bezel, as explained hereinafter with reference to FIGS. 2 and 3. A first circular hollow cam 14 is formed in the external vertical wall of foot 13 of top bezel 10 with an angular aperture $\alpha$ in the clockwise direction, said cam 14 cooperating with a stop member 24 of the vertical wall opposite bottom bezel 20. A second circular hollow cam 15 is formed in ring 8*a* of shoulder 8 with an angular aperture $\beta$ in the anti-clockwise direction, said second cam 15 cooperating with a stop member 25 formed at the base of bottom bezel 20 in the part covering ring 8*a*. In the example shown in FIGS. 1 and 4 to 7, $\alpha$=90° and $\beta$=45°. Thus, when top bezel 10 rotates through 90° in the anti-clockwise direction, stop member 24 follows cam 14 to the position shown in FIG. 5, without moving bottom bezel 20. While continuing to rotate top bezel 10, lateral stop member 24 then drives bottom bezel 20 until lower stop member 25 abuts the end of cam 15 to immobilise the two bezels in the position shown in FIG. 7. It is of course possible to choose other angular apertures, for example $\alpha$=$\beta$=60°, to have perfect symmetry after total rotation. Instead of having cams 14 and 15 arranged on either side of the 3 o'clock position, it is of course possible to arrange them at any other location on the vertical wall of foot 13 and ring 8*a* of shoulder 8. Likewise, it is possible to invert the stop members and cams on opposite walls, for example to arrange cam 14 in bottom bezel 20 and stop member 24 on top bezel 10.

In the embodiment that has just been described, top bezel 10 and bottom bezel 20 have oblique extensions 11, 21 facilitating the manipulation thereof, whether or not there are guide cams 14, 15 limiting the clearance of bezels 10, 20.

In other embodiments, shown in FIGS. 8, 9 and 10, 11, the two bezels are totally superposed.

Figure 8:
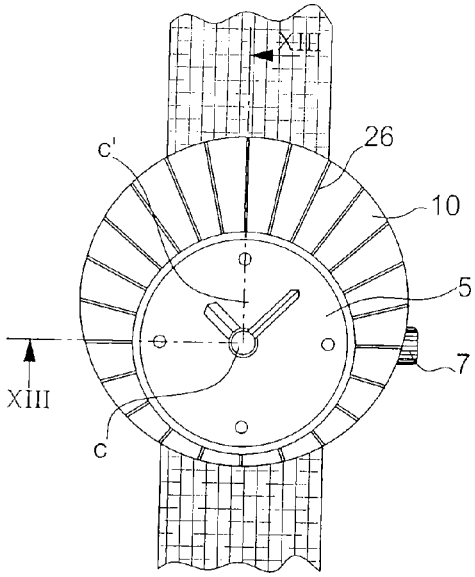
FIGS. 8 and 9 show a second embodiment when the rotating bezels are respectively in the rest position and spread out position?
Figure 9:
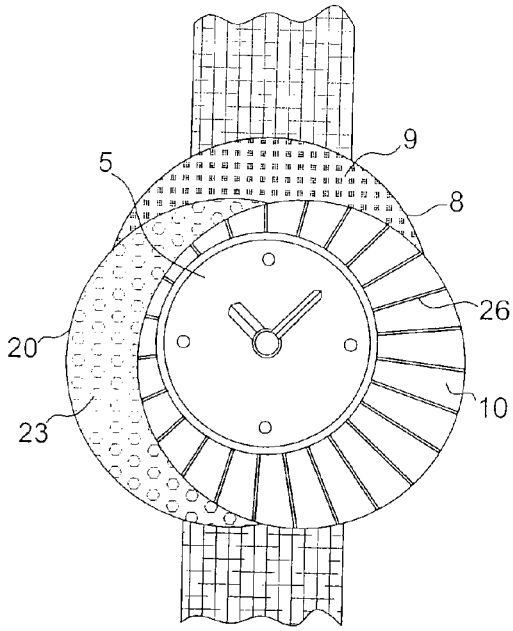
Figure 13A:
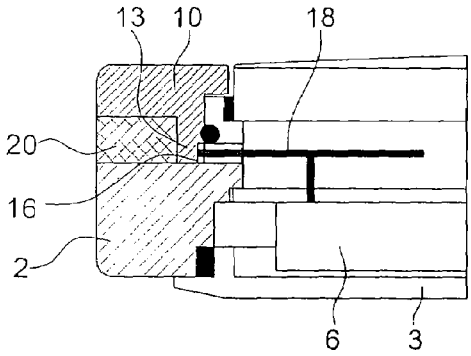
FIGS. 13A and 13B show a cross-section along the line XIII-XIII of FIG. 8.
Figure 13B:
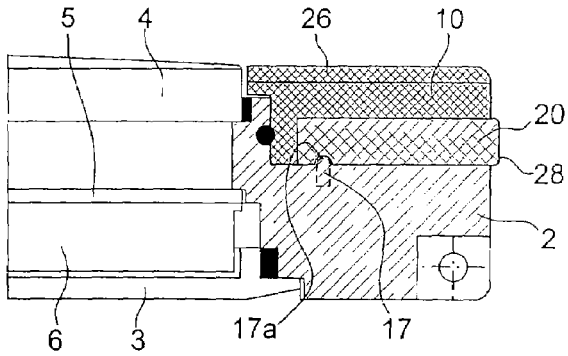

FIG. 8 shows a second embodiment which differs from that previously described in that the two superposed bezels 10, 20 are perfectly circular, but have a centre C' shifted in relation to centre C of the dial. As can be seen in FIG. 9, by rotating bezels 10, 20, one can alter the external appearance of the wristwatch. Referring also to FIG. 13B, it can be seen that a knurling 26 on top bezel 10 and a lateral knurling 28 on bottom bezel 20 can facilitate manipulation of the bezels. FIG. 13B also shows schematically a contactor 17, for example a pressure contactor or a magnetic contactor, for activating a function of the wristwatch by rotating bottom bezel 20 through an angle greater than that of a groove 17*a*. Conversely, the cross-section of FIG. 13A shows another embodiment in which foot 13 of top bezel 10 is provided with a toothed sector 16 for driving said bezel in rotation by means of a toothed wheel 18, the rotation of which can be controlled or programmed by means of external control member 7. If the two bezels 10, 20 are provided with cams as previously described, bottom bezel 20 will also be driven. It is for example possible to programme a determined time at which the two bezels will go into the position corresponding to that shown in FIG. 7.

Figure 10:
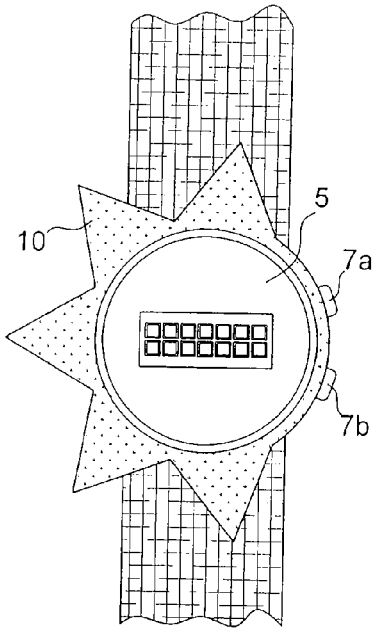
FIGS. 10 and 11 show a third embodiment when the rotating bezels are respectively in the rest position and spread out position.
Figure 11:
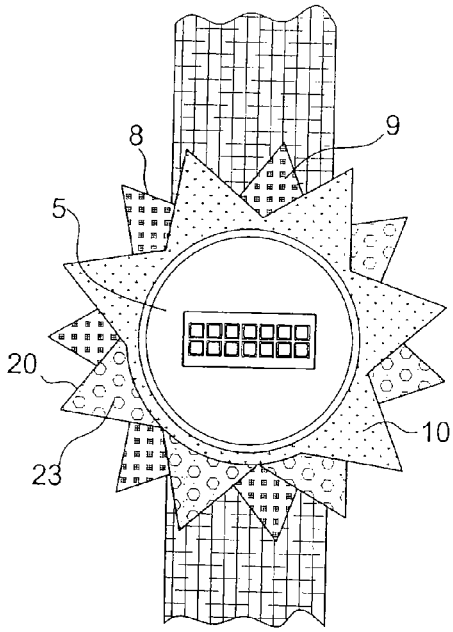

Referring now to FIGS. 10 and 11, there is shown a wristwatch watch with a digital liquid crystal display, provided with two push-buttons 7*a*, 7*b* and comprising two rotating bezels 10, 20 superposed in the rest position and of totally asymmetrical shape. As can be seen in FIG. 11, the appearance of the wristwatch is totally altered after rotating bezels 10, 20.

Figure 12:
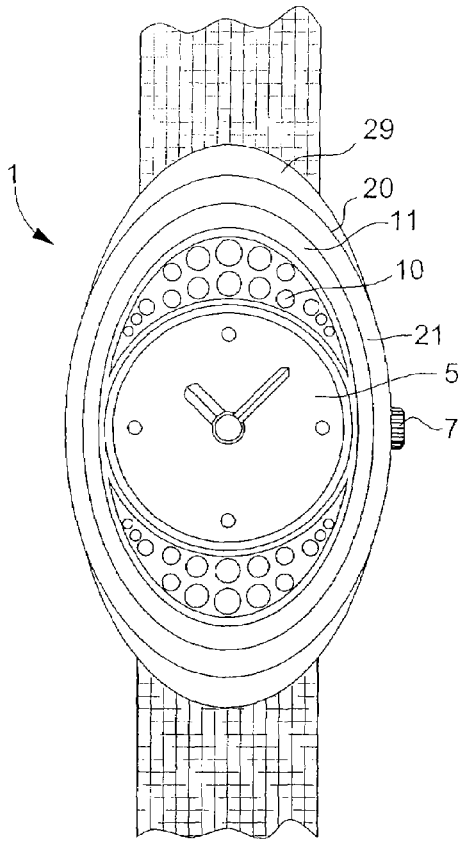
FIG. 12 is a top view of a fourth embodiment.

FIG. 12 shows yet another embodiment that differs from that shown in FIG. 1 in that the concealed parts 9 of shoulder 8 have extensions 29 that are permanently visible in the rest position producing an additional aesthetic effect.

The invention claimed is:

1. Timepiece including a case formed of a back cover and a middle part closed by a glass arranged above a dial with an analogue or digital display, delimiting the housing of a watch movement, said glass being surrounded by two external rotating top and bottom bezels, superposed on a shoulder of the middle part, wherein the two bezels and the shoulder have identical or similar non-circular or non-symmetrical contours in relation to the centre of the dial in the superposed position, and wherein the bezels can occupy a first rest position in which concealed parts of the shoulder and/or concealed parts of the bottom bezel are made visible after rotation of at least one bezel.

2. Timepiece according to claim 1, wherein the top bezel totally covers the bottom bezel which itself totally covers the shoulder.

3. Timepiece according to claim 2, wherein the bottom bezel is provided with a lateral manoeuvring knurling.

4. Timepiece according to claim 1, wherein the bottom bezel includes a strip extending beyond the contour of the top bezel.

5. Timepiece according to claim 1, wherein the concealed parts of the shoulder of the middle part include an extension extending beyond the contour of the bottom bezel.

6. Timepiece according to claim 1, wherein the two rotating bezels have a symmetrical oblong contour in relation to the 12 o'clock-6 o'clock and 3 o'clock-9o'clock directions in the rest position.

7. Timepiece according to claim 6, wherein the two rotating bezels have a curved contour.

8. Timepiece according to claim 1, wherein the two rotating bezels have a circular contour with a centre that is offset with respect to the centre of the dial.

9. Timepiece according to claim 1, wherein the bottom bezel includes on its inner lateral wall a stop member cooperating with a circular hollow cam formed in the external lateral wall of the top bezel.

10. Timepiece according to claim 9, wherein the cam of the top bezel is formed by an arc of a circle with an aperture $\alpha$ allowing free rotation of the top bezel without driving the bottom bezel.

11. Timepiece according to claim 9, wherein the bottom bezel includes at its base a stop member cooperating with a circular hollow cam formed in the shoulder (8) of the middle part.

12. Timepiece according to claim 11, wherein the cam of the shoulder is formed by an arc of a circle with an aperture $\beta$ for limiting the rotation of the bottom bezel when it is driven in rotation by the top bezel.

13. Timepiece according to claim 10, wherein $\alpha=90°$.

14. Timepiece according to claim 12, wherein $\beta=45°$.

15. Timepiece according to claim 10, wherein $\alpha=\beta=60°$ allowing an angular shift of 120° between the shoulder, the bottom bezel and the top bezel.

16. Timepiece according to claim 1, wherein the foot of the top bezel includes on a part of its inner periphery a toothed sector meshing with a toothed wheel of the movement and which is started by activating an external control member or by a control signal programmed in the movement.

17. Timepiece according to claim 1, wherein the rotation of the bezels controls the ON/OFF switch of a time function such as an alarm time.

18. Timepiece according to claim 1, wherein the concealed parts in the rest position carry decoration or jewellery elements.

19. Timepiece according to claim 11, wherein $\alpha=\beta=60°$ allowing an angular shift of 120° between the shoulder, the bottom bezel and the top bezel.

* * * * *